US005947869A

United States Patent [19]

Shea

[11] Patent Number: 5,947,869

[45] **Date of Patent: *Sep. 7, 1999**

[54] EXERCISE APPARATUS

[76] Inventor: Michael J. Shea, 1726 Creek Crossing Rd., Vienna, Va. 22182

[ * ] Notice: This patent issued on a continued prosecution application filed under 37 CFR 1.53(d), and is subject to the twenty year patent term provisions of 35 U.S.C. 154(a)(2).

[21] Appl. No.: 08/385,171

[22] Filed: Feb. 7, 1995

[51] Int. Cl.[6] ..... A63B 21/00

[52] U.S. Cl. ..... 482/8; 482/57; 482/900; 482/901

[58] Field of Search ..... 482/1–9, 57, 90, 482/900–902

[56] References Cited

U.S. PATENT DOCUMENTS

| | | | |
|---|---|---|---|
| 3,767,195 | 10/1973 | Dimick . | |
| 4,358,105 | 11/1982 | Sweeney, Jr. . | |
| 4,642,769 | 2/1987 | Petrofsky | 482/8 X |
| 5,387,164 | 2/1995 | Brown | 482/8 X |

*Primary Examiner*—Glenn E. Richman

[57] ABSTRACT

An exercise apparatus includes an exercise device and a control unit having a port for receiving a portable memory module storing one or more exercise programs, selecting circuitry for selecting exercise programs stored on the portable memory module, and a processor for executing a selected one of the exercise programs to control the exercise device.

21 Claims, 12 Drawing Sheets

| | | | | |
|---|---|---|---|---|
| 1 | PROGRAM | NAME AND DESCR. | DIFF. LEVEL | EXER. TIME |
| 2 | PROGRAM | NAME AND DESCR. | DIFF. LEVEL | EXER. TIME |
| 3 | PROGRAM | NAME AND DESCR. | DIFF. LEVEL | EXER. TIME |
| ⋮ | ⋮ | ⋮ | ⋮ | ⋮ |
| n | PROGRAM | NAME AND DESCR. | DIFF. LEVEL | EXER. TIME |

FIG. 6

| | | | | | | |
|---|---|---|---|---|---|---|
| 1 | PROGRAM | NAME AND DESCR. | DIFF. LEVEL | EXER. TIME | NEXT | FLAG |
| 2 | PROGRAM | NAME AND DESCR. | DIFF. LEVEL | EXER. TIME | NEXT | FLAG |
| 3 | PROGRAM | NAME AND DESCR. | DIFF. LEVEL | EXER. TIME | NEXT | FLAG |
| ⋮ | ⋮ | ⋮ | ⋮ | ⋮ | ⋮ | ⋮ |
| n | PROGRAM | NAME AND DESCR. | DIFF. LEVEL | EXER. TIME | NEXT | FLAG |

FIG. 8A

| | | | | | |
|---|---|---|---|---|---|
| 1 | PROGRAM | NAME AND DESCR. | DIFF. LEVEL | EXER. TIME | SUN |
| 2 | PROGRAM | NAME AND DESCR. | DIFF. LEVEL | EXER. TIME | MON |
| 3 | PROGRAM | NAME AND DESCR. | DIFF. LEVEL | EXER. TIME | TUE |
| 4 | PROGRAM | NAME AND DESCR. | DIFF. LEVEL | EXER. TIME | WED |
| 5 | PROGRAM | NAME AND DESCR. | DIFF. LEVEL | EXER. TIME | THU |
| 6 | PROGRAM | NAME AND DESCR. | DIFF. LEVEL | EXER. TIME | FRI |
| 7 | PROGRAM | NAME AND DESCR. | DIFF. LEVEL | EXER. TIME | SAT |

FIG. 9C

| | | | | | |
|---|---|---|---|---|---|
| 1 | APP. ID | PROGRAM | NAME AND DESC. | DIFF. LEVEL | EXER. TIME |
| 2 | APP. ID | PROGRAM | NAME AND DESC. | DIFF. LEVEL | EXER. TIME |
| 3 | APP. ID | PROGRAM | NAME AND DESC. | DIFF. LEVEL | EXER. TIME |
| ⋮ | ⋮ | ⋮ | ⋮ | ⋮ | ⋮ |
| n | APP. ID | PROGRAM | NAME AND DESC. | DIFF. LEVEL | EXER. TIME |

FIG. 10

| | | | | | | |
|---|---|---|---|---|---|---|
| WORK-OUT 1 | APP. ID | DATE | COMPLETE ? | PROG. NAME | DIFF. LEVEL | EXER. TIME |
| WORK-OUT 2 | APP. ID | DATE | COMPLETE ? | PROG. NAME | DIFF. LEVEL | EXER. TIME |
| WORK-OUT 3 | APP. ID | DATE | COMPLETE ? | PROG. NAME | DIFF. LEVEL | EXER. TIME |
| ⋮ | ⋮ | ⋮ | ⋮ | ⋮ | ⋮ | ⋮ |
| WORK-OUT n | APP. ID | DATE | COMPLETE ? | PROG. NAME | DIFF. LEVEL | EXER. TIME |

FIG. 11

EXERCISE APPARATUS

BACKGROUND OF THE INVENTION

1. Technical Field

The present invention generally relates to an exercise apparatus and, more particularly, to an exercise apparatus which includes an exercise device which is controllable by a microprocessor in accordance with programs for automatically setting and/or varying exercise levels.

2. Description of Related Art

Many exercisers currently utilize one or more exercise devices in their training routines. These exercise devices include, for example, weight machines, stair climbers, treadmills, and stationary bicycles. Some of these devices are controllable by microcomputers in accordance with exerciser-selected programs which set and/or vary the exercise level during program execution. FIGS. 1 and 2 illustrate a stationary bicycle 5 which provides automatically-varying exercise levels as disclosed in U.S. Pat. No. 4,358,105 to Sweeney, Jr. The control system for the stationary bicycle includes a microcomputer 10 which communicates electronically with a keyboard 12, a read-only memory 14, and a display 16. The read-only memory 14 stores the operating program for microcomputer 10 and a plurality of pre-stored exercise programs which are selectable by an exerciser. Movement of pedals 20 rotates a sprocket 22, which causes a chain 24 to drive a small diameter sprocket 26 attached to a flywheel 28. The variable load which an exerciser must overcome in order to rotate sprocket 22 is generated by an alternator 30, which provides a variable resistance to the effort of the exerciser through its driving connection with flywheel 28 by a gear belt 32. Microcomputer 10 controls the loading circuit of alternator 30. The output of microcomputer 10 on line 34 is a pulse width modulated signal, the width of which is proportional to the effort required by the exerciser. The changes in pulse width vary the field current in the alternator to cause variations in the resistance of the alternator to the force exerted by the operator. An exerciser using the stationary bicycle may select a pre-stored exercise program from read-only memory 14 for execution by microcomputer 10 to automatically vary the exercise difficulty level by generating pulses whose width is a function of the effort required by the exerciser. Using keyboard 12, an exerciser is also able to select a difficulty level and an exercise time.

From workout to workout, an exerciser will often select different exercise programs and set different difficulty levels and/or exercise times in order, for example, to achieve particular fitness goals and/or to avoid injury. Thus, for example, an exerciser may select an exercise program, difficulty level, and exercise time which define a relatively easy workout on a day following a hard workout. In addition, after several months of a training routine, an exerciser will likely find that he or she is able to use an exercise device at higher difficulty levels and/or for longer exercise times. Thus, an exerciser will likely find that he or she is capable of pedaling a stationary bicycle in accordance with selected exercise programs for a longer exercise time at a higher difficulty level than at the beginning of the training routine. Similarly, an exerciser using a weight machine will likely find that he or she will be able to perform more repetitions using more weight (or resistance) after several months of a training program.

However, exercise apparatus of the type described above typically provide only a limited number of exercise programs from which an exerciser may select. While a manufacturer could provide a greater number of pre-stored exercise programs, this would require an increase in the size of read-only memory 14, and yet still not ensure that the exercise programs satisfy the requirements of all exercisers, particularly exercisers having specific exercise needs or goals. This problem is magnified if the exercise apparatus is placed in a health club where it will be utilized by many persons having widely varying fitness levels and fitness goals.

In addition, exercisers unfamiliar with an exercise apparatus may have problems selecting one of the pre-stored exercise programs. Further, exercisers attempting to achieve specific fitness goals may have problems selecting exercise programs in a manner which best assist them in achieving their goals and in maximizing the benefits of workouts. While a health club may have trainers to provide instructions on how to utilize various exercise apparatus to improve fitness, these instructions may be difficult to remember and will change as the fitness level of the exerciser increases. Additionally, exercisers who use exercise apparatus at home generally do not have trainers available to guide them through the selection of particular exercise programs to achieve specific exercise goals.

These limitations on prior art exercise apparatus may cause a person to not exercise frequently or may cause an exerciser to not receive the full benefits of his or her exercise because selected exercise programs are either too easy or too difficult or not well-suited to the ultimate fitness goals of the exerciser.

SUMMARY OF THE INVENTION

According to one aspect of the invention, an exercise apparatus includes an exercise device and a control unit having a port for receiving a portable memory module storing one or more exercise programs, selecting circuitry for selecting exercise programs stored on the portable memory module, and a processor for executing a selected one of the exercise programs to control the exercise device.

According to another aspect of the invention, a portable memory module includes a memory for storing one or more exercise programs for controlling a first exercise device and one or more exercise programs for controlling a second exercise device different than the first exercise device.

According to another aspect of the invention, an exercise apparatus includes an exercise device and a control unit having selecting circuitry for selecting exercise programs stored in one or the other of first and second physically discrete memories and a processor for executing a selected one of the exercise programs to control the exercise device.

According to yet another aspect of the invention, an exercise apparatus includes an exercise device and a control unit having a memory for storing one or more exercise programs, the one or more exercise programs including exercise programs arranged in an exercise program sequence, selecting circuitry for sequentially selecting the exercise programs in the exercise program sequence, and a processor for executing the sequentially selected exercise programs to control the exercise device.

In accordance with yet another aspect of the present invention, an exercise apparatus includes an exercise device and a control unit having a real time clock for generating real time signals, selecting circuitry for selecting exercise programs in accordance with the real time signals, and a processor for executing selected exercise programs to control the exercise device.

The features and advantages of the present invention will be better understood from a reading of the following detailed description in conjunction with the accompanying drawings.

BRIEF DESCRIPTION OF THE DRAWINGS

FIG. 6 is a table depicting an organization of exercise programs stored on portable memory module 103.

FIG. 8A illustrates a memory organization for storing a sequence of exercise programs.

FIG. 9C is a table depicting an organization of an exercise program sequence.

FIG. 10 is a table depicting an organization of exercise programs which permits a portable memory module to be used with more than one exercise apparatus.

FIG. 11 is a table depicting an organization of a memory storing a training history.

DETAILED DESCRIPTION

Figure 1:
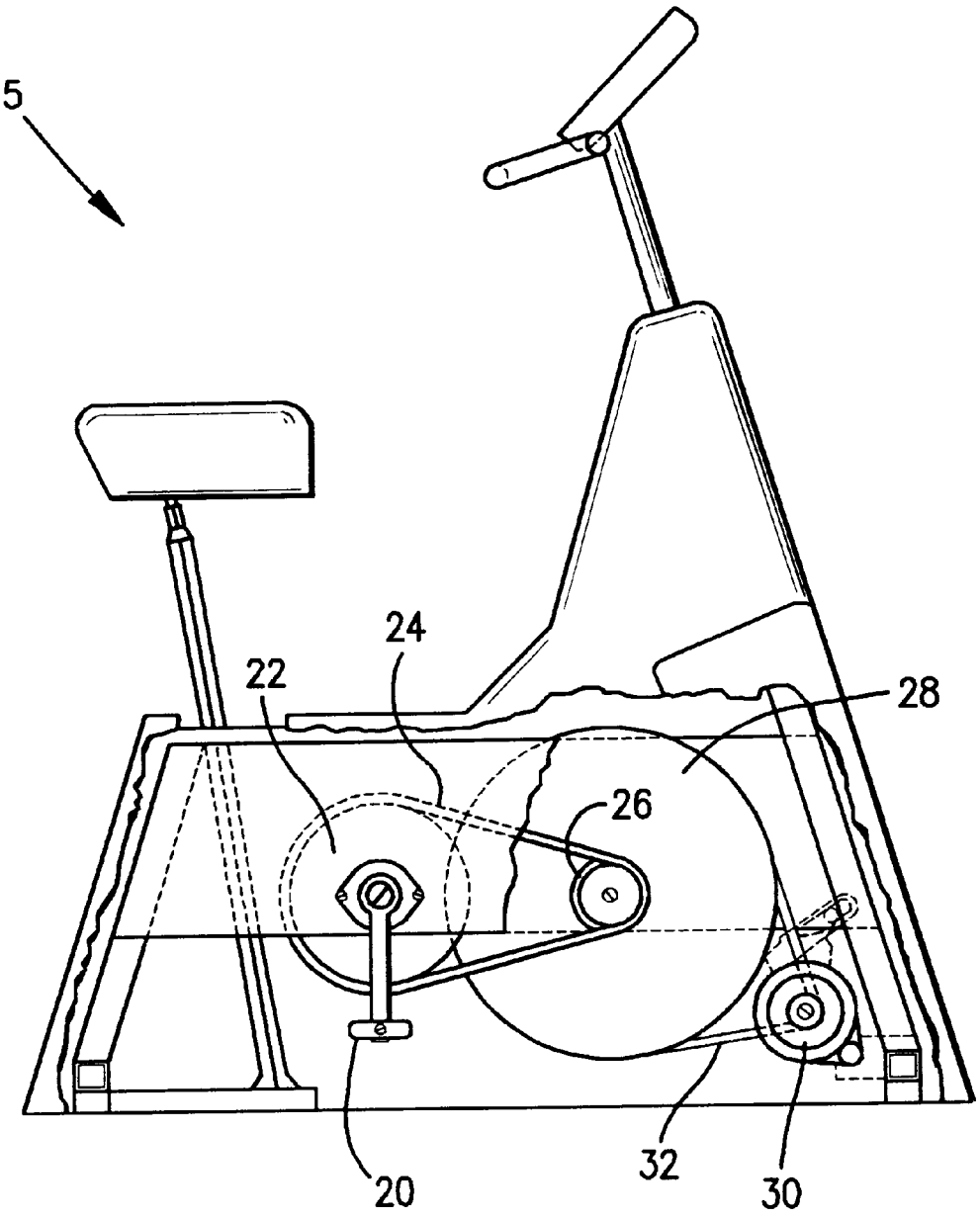
FIG. 1 PRIOR ART
FIG. 1 is a side elevational view of a prior art stationary bicycle 5.
Figure 2:
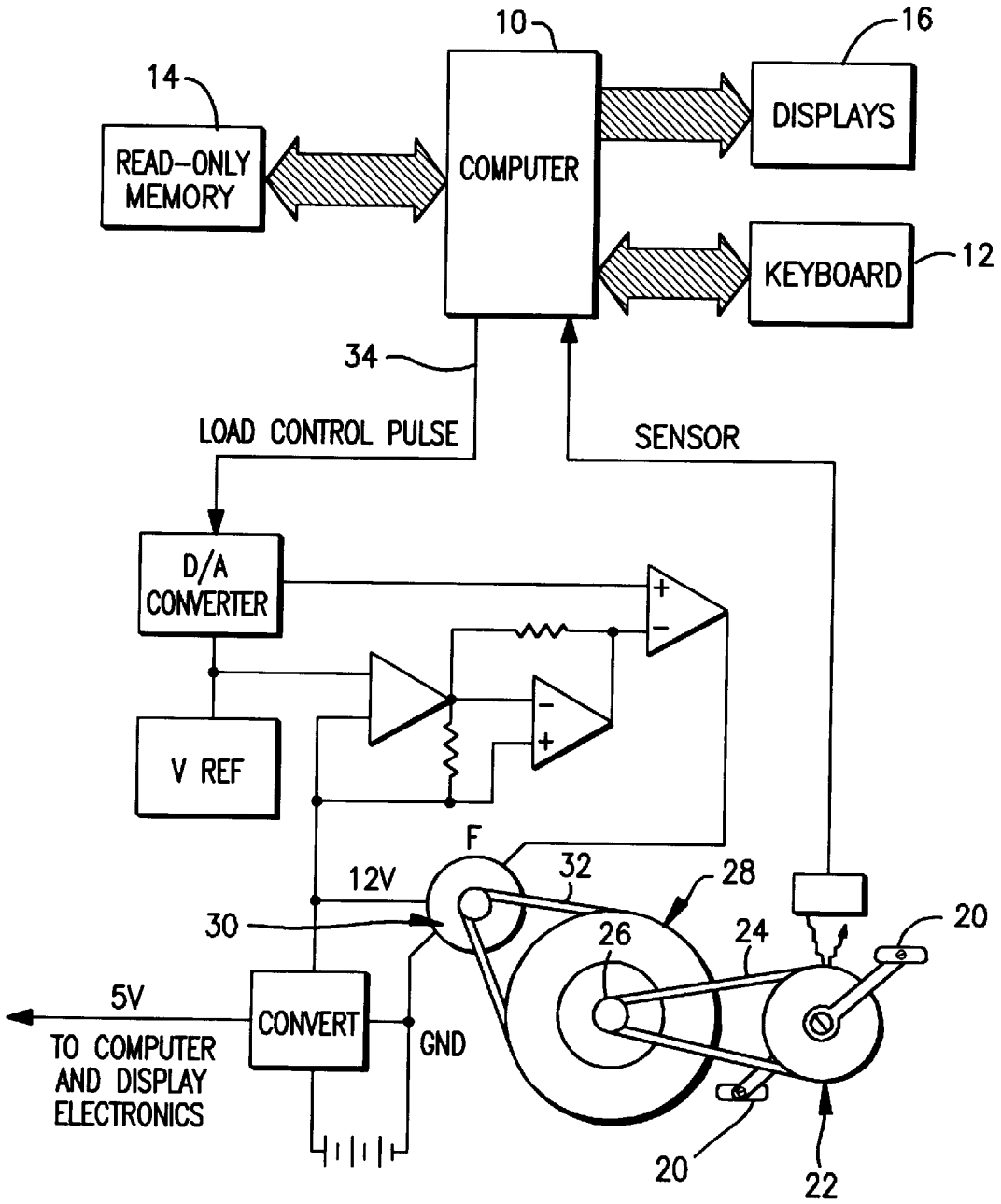
FIG. 2 PRIOR ART
FIG. 2 is a schematic showing the electronic control system of stationary bicycle 5 of FIG. 1.
Figure 3:
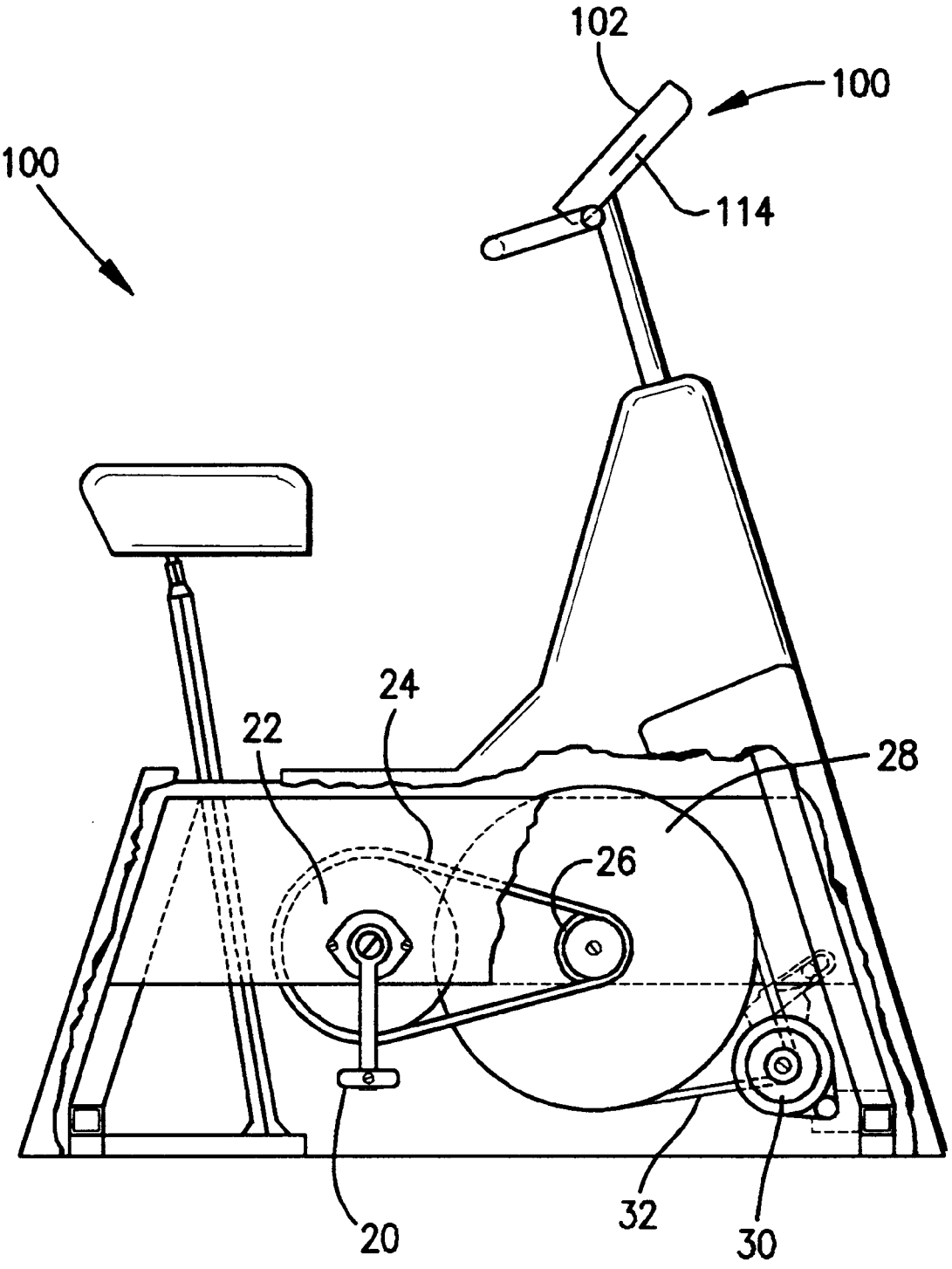
FIG. 3 is a side elevational view of a stationary bicycle 100 in accordance with the present invention.
Figure 4:
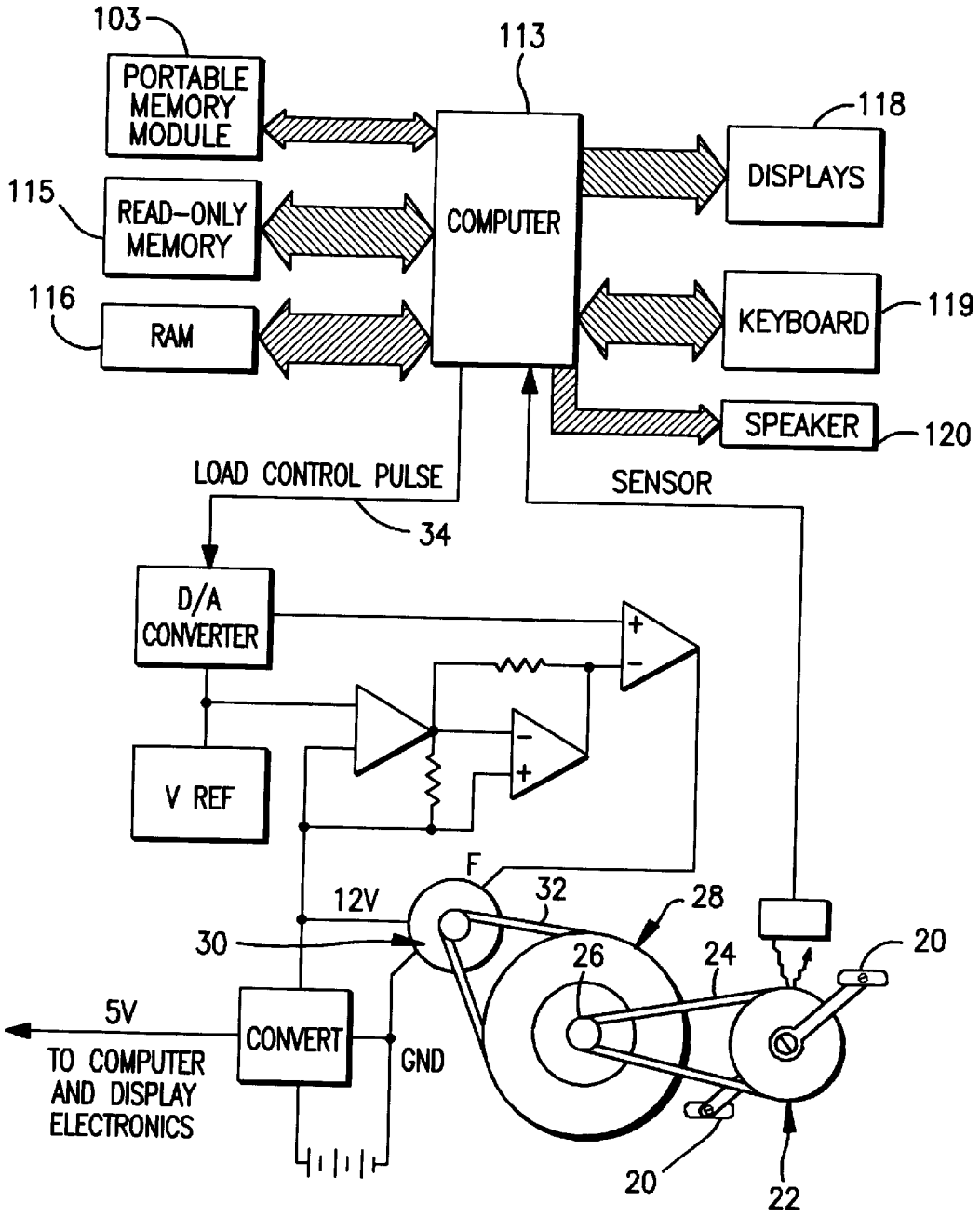
FIG. 4 is a schematic showing the electronic control system of stationary bicycle 100 of FIG. 3.

FIGS. 3 and 4 illustrate a stationary bicycle 100 in accordance with the present invention. Elements of stationary bicycle 100 which are the same as those of stationary bicycle 5 shown in FIGS. 1 and 2 are designated with the same reference numbers and descriptions thereof are omitted. Although the present invention is illustrated and described herein with reference to a stationary bicycle, the teachings of the present invention are applicable to any exercise apparatus including an exercise device whose exercise level is controllable by a microcomputer in accordance with a program, including by way of example, but not by way of limitation, stationary bicycles, stair climbers, treadmills, and weight machines. Display and keypad panel 102 includes a port 114 which is adapted to receive a portable memory module 103 having a memory for storing at least one exercise program for controlling stationary bicycle 100. Although port 114 is illustrated as being positioned on a side portion of display and keypad panel 102, it will be appreciated that port 114 may be positioned elsewhere. Portable memory module 103 is a module of non-volatile memory such as an electrically alterable and readable memory which may be plugged into and removed from port 114. While a variety of portable memory media are suitable for use in the system of the present invention, it is preferable to use a small card or plastic holder containing therein an electrically erasable programmable read-only memory (EEPROM). Other suitable portable, removable magnetic or electronic digital memory modules such as EPROMs, magnetic cards, and cards having magnetic strips may also be used. The use of a portable memory module such as an EEPROM allows for a small and lightweight module which can be readily transported and which can easily be plugged into and removed from port 114. An EEPROM is advantageous because of its ease of re-use and adaptability. A volatile memory could also be used if a long-life power supply such as a battery is built into the card. Portable memory module 103 should mate with the control system of stationary bicycle 100 so that the microcomputer of the control system can read data from and write data to the portable memory module.

The control system of stationary bicycle 100 includes a microcomputer 113 for controlling the operation of stationary bicycle 100, a read-only memory (ROM) 115, a random access memory (RAM) 116, a display 118, a keypad 119, and a speaker 120. ROM 115 stores an operating program of microcomputer 113 and may also contain various pre-stored exerciser-selectable programs for controlling stationary bicycle 100. Microcomputer 113 generates control signals supplied over line 34 for controlling the exercise level of stationary bicycle 100 in accordance with an exercise program selected either from portable memory module 103 or ROM 115. RAM 116 may be provided, for example, to temporarily store data during program execution. Display 118 includes, for example, light emitting diodes (LEDs) and/or liquid crystal displays (LCDs) and is responsive to signals from microcomputer 113 for displaying various information to the exerciser including, but not limited to, the exercise time, the exercise level, number of calories burned, and the like as is known in the art. Keypad 119 includes exerciser-operable keys for inputting various data as will be discussed below. Speaker 120 is responsive to microcomputer 113 for providing audible sounds to the exerciser to indicate, for example, the end of an exercise program or an incorrect selection or entry via keypad 119.

Figure 5:
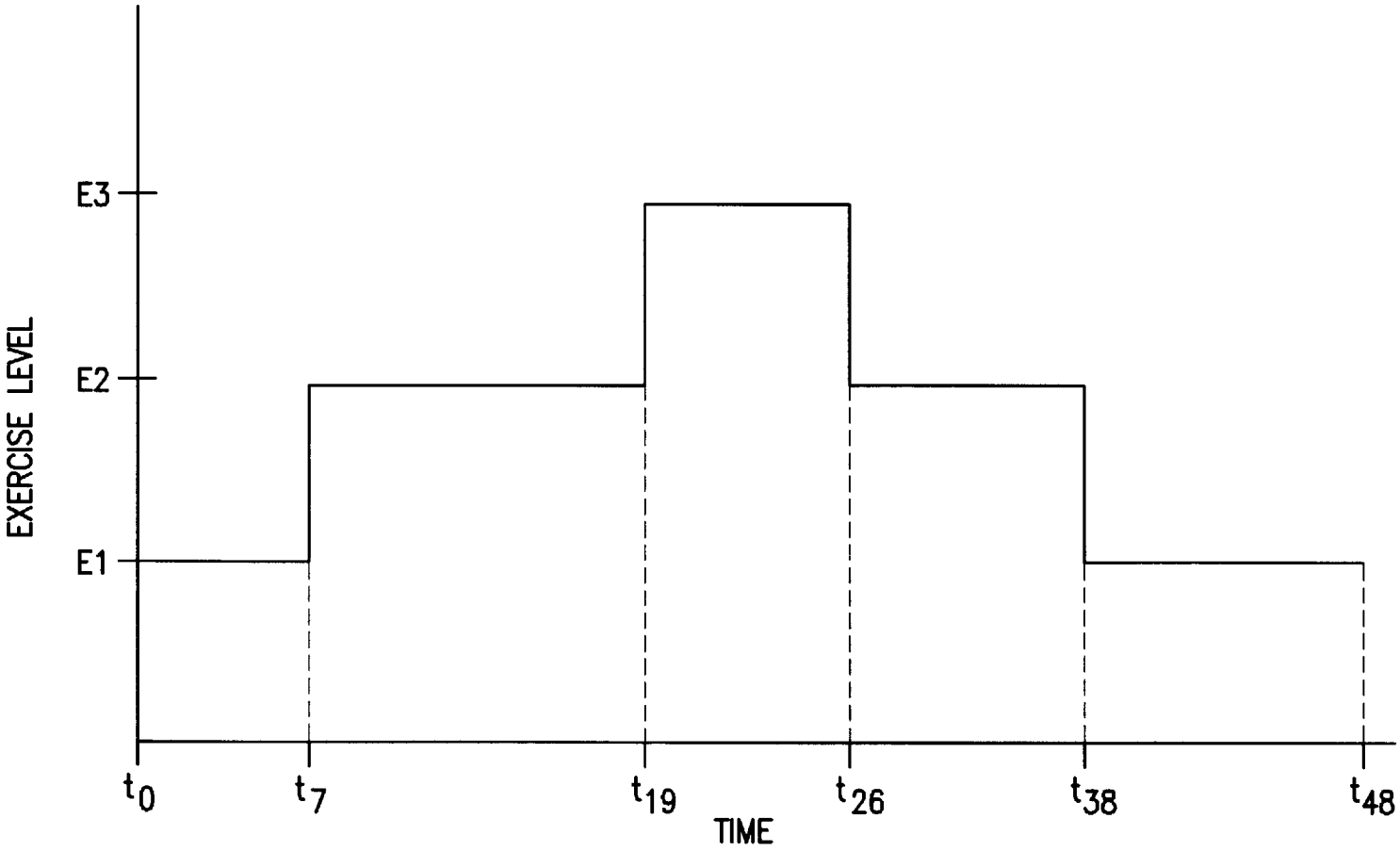
FIG. 5 is a graphical profile of exercise level versus time for an exercise program which may be utilized by microcomputer 113 of FIG. 4 to automatically control the exercise level of stationary bicycle 100.

Portable memory module 103 stores at least one exercise program for automatically controlling stationary bicycle 100. FIG. 5 is a graphical profile of exercise level versus time for an illustrative, but non-limiting, exercise program which may be utilized by microcomputer 113 to automatically control the exercise level of stationary bicycle 100. As illustrated in the profile of FIG. 5, from exercise time to until exercise time $t_7$, microcomputer 113 generates control signals for setting the exercise level of stationary bicycle 100 to exercise level El; from exercise time $t_7$ until exercise time $t_{19}$, microcomputer 113 generates control signals for setting the exercise level of stationary bicycle 100 to exercise level E2; from exercise time $t_{19}$ until exercise time $t_{26}$, microcomputer 113 generates control signals for setting the exercise level of stationary bicycle 100 to exercise level E3; from exercise time $t_{26}$ until exercise time $t_{38}$, microcomputer 113 generates control signals for setting the exercise level of stationary bicycle 100 to exercise level E2; and from exercise time $t_{38}$ until exercise time $t_{48}$ (the end of the program), microcomputer 113 generates control signals for setting the exercise level of stationary bicycle 100 to exercise level El. When a program having the profile of FIG. 5 is selected, an exerciser may select an exercise time over which microcomputer 113 will control stationary bicycle 100. The selection of an exercise time determines the time interval between the exercise times. For example, when an exercise program having the profile of FIG. 5 is selected, an exerciser may choose an exercise time of four, eight, twelve, sixteen, or twenty minutes. Depending on which total exercise time is selected, the time interval between the exercise times is five, ten, fifteen, twenty, or twenty-five seconds, respectively. An exerciser may also select a difficulty level which determines the difficulty of the exercise at the exercise levels of the program. The difficulty of exercise levels E1, E2, and E3 is generally less at low difficulty levels than at high difficulty levels. Thus, as the fitness level of an exerciser increases, higher difficulty levels may be utilized.

FIG. 6 is a table depicting an organization of exercise programs stored on portable memory module 103. Exercise program 1 is stored at memory location 1, defined for example, by a memory address. If desired, a program name and description, a difficulty level, and/or an exercise time may be associated with exercise program 1. If a difficulty level and/or exercise time are not associated with an exercise program, these items may be set by the exerciser. Exercise programs 2, 3, . . . , n are stored at memory locations 2, 3, . . . , n as indicated. The operating program of microcomputer 113 stored in ROM 115 is configured to permit microcomputer 113 to access these exercise programs when portable memory module 103 is plugged into port 114 and to permit an exerciser to select an exercise program which is stored on portable memory module 103 or in ROM 115. Of course, the exercise programs may be organized in various ways on portable memory module 103 and the invention is not limited in this respect.

Figure 7:
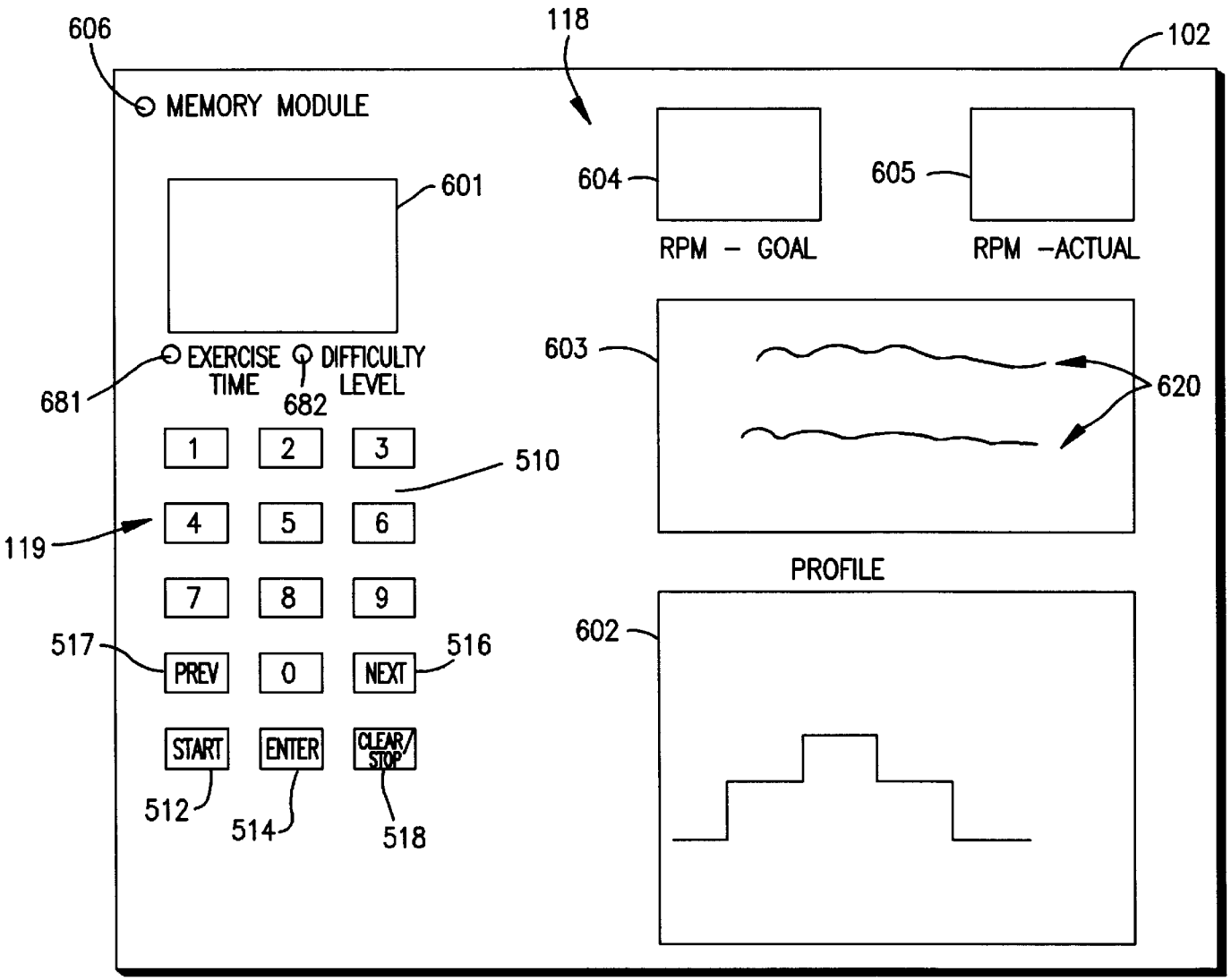
FIG. 7 illustrates display 118 and keypad 119 of display and keypad panel 102 shown in FIG. 3.

FIG. 7 illustrates display 118 and keypad 119 arranged on display and keypad panel 102. Display 118 includes various display portions 601–605. During program selection, display portion 601, exercise time indicator 681, and difficulty level indicator 682 may prompt an exerciser to enter an exercise time and difficulty level for an exercise program or may display the exercise time and difficulty level stored along with an exercise program as noted above. During exercise, display portion 601 alternately displays an elapsed exercise time and current difficulty level of the exercise program. Exercise time indicator 681 and difficulty level indicator 682 are LEDs, for example, which are appropriately illuminated to indicate which quantity should be entered by the exerciser during program selection and to indicate the current display content during exercise. Exercise level display portion 602 displays a graphical profile of exercise level versus time for the exercise program such as is shown, for example, in FIG. 5. Display portion 603 is a line display including one or more lines 620 which may display graphical and text information such as program names and descriptions and operating instructions to an exerciser. Display portion 604 provides a display relating to how fast an exerciser should be pedaling stationary bicycle 100 at a current exercise level and display portion 605 provides a display of how fast an exerciser is actually pedaling. Displays of other information such as calories burned may also be provided, if desired. A portable memory module indicator 606 is illuminated if a portable memory module 103 is plugged into port 114 and is accessible by microcomputer 113 for executing programs stored thereon. It will be appreciated that the displays of stationary bicycles and other exercise apparatus may be varied in accordance with the information which it is desired to display and the present invention is not limited in this respect. Keypad 119 includes a numeric keyboard portion 510 having numeric keys 0–9; a START key 512; an ENTER key 514; a NEXT key 516; a PREV (previous) key 517; and a CLEAR/STOP key 518.

To select an exercise program, an exerciser actuates START key 512. Microcomputer 113 causes portable memory module indicator 606 to be illuminated if a portable memory module 103 is plugged into port 114 and is accessible by microcomputer 113 for executing programs stored thereon. If a portable memory module is plugged into port 114, but is for some reason not accessible by microcomputer 113, microcomputer 113 may cause display 118 to provide text on line display portion 603 indicating this problem. Microcomputer 113 prompts the exerciser to select an exercise program. If the portable memory module 103 is plugged into port 114 and is accessible by microcomputer 113, a program is selectable from among the programs stored on the portable memory module 103 or in ROM 115. If the portable memory module is not plugged into port 114 or is not accessible by microcomputer 113, a program is selectable from among the programs stored in ROM 115. The exerciser may be prompted to select an exercise program by, for example, displaying the program name and description on line display portion 603 and additionally or alternatively displaying a corresponding graphical profile of the exercise level versus time on display portion 602. The exerciser is able to step forward and backward through the available exercise programs using NEXT key 516 and PREV key 517. For example, using the NEXT key 516 and PREV key 517, an exerciser may cause microcomputer 113 to step forward and backward through the programs on portable memory module 103 and the programs in ROM 115. To select an exercise program whose program name, program description, and/or profile is displayed, the exerciser actuates ENTER key 514. If appropriate for the selected exercise program, the exerciser is prompted to enter an exercise time and difficulty level. If an exercise time and/or difficulty level are stored along with the selected exercise program, the user may simply press ENTER key 514 to execute the program using these stored values or may change these values prior to pressing ENTER key 514. When ENTER key 514 is pressed, microcomputer 113 controls stationary bicycle 100 in accordance with the exercise program, exercise time, and difficulty level. During the program, microcomputer 113 controls display 118 to display data such as the elapsed exercise time to the exerciser, current difficulty level, RPM-GOAL, RPM-ACTUAL, and the like. Display portion 602 may be appropriately illuminated to indicate an exerciser's progress through the exercise profile. At the end of the exercise program, microcomputer 113 drives speaker 120 to output an audible sound indicating the end of the program. Program execution may be stopped prior to the end of the program by pressing CLEAR/STOP key 518.

An almost limitless number of exercise programs may be developed in which the exercise level of the exercise device is varied over time. It will be apparent that some exercise programs will be better suited to individuals who are just beginning an exercise routine, other programs will be suited for individuals in top physical condition, and still other programs will be suitable for individuals whose fitness level is somewhere between these two extremes. By providing a portable memory module containing exercise programs which may be plugged into the exercise apparatus, an exerciser will be able to select from a large variety of exercise programs without increasing the size of the on-board memory of the exercise apparatus.

An additional benefit of the present invention resides in the ability to include on a portable memory module exercise programs tailored for a specific individual. It may be difficult for an exerciser to determine which exercise program or programs are suitable to achieving his or her fitness goals and even more difficult to find such exercise programs among a relatively small selection of programs which are generally stored in a conventional exercise apparatus or to program the device to include appropriate exercise programs. In accordance with the present invention, an exerciser can use exercise programs developed by a personal trainer or a physician by simply plugging a portable memory module having programs for his or her personal training routine into the exercise apparatus. The exerciser may thus select from a plurality of programs which have been specifically developed for his or her fitness level and/or to achieve specific training goals. As an exerciser's fitness level increases or specific training goals are reached, a different portable memory module may be used or different programs may be written to a currently used portable memory module.

The exercise programs may be developed by using a computer such as an IBM®-compatible personal computer to create a software programs which are executable by the microcomputer 113 and which specify the exercise level as a function of time. A program title, description, exercise time, difficulty level, etc. may then be associated with each program as discussed above. The programs and associated information may then be written to the portable memory module using appropriate memory programming circuitry as is well known in the art.

Figure 8B:
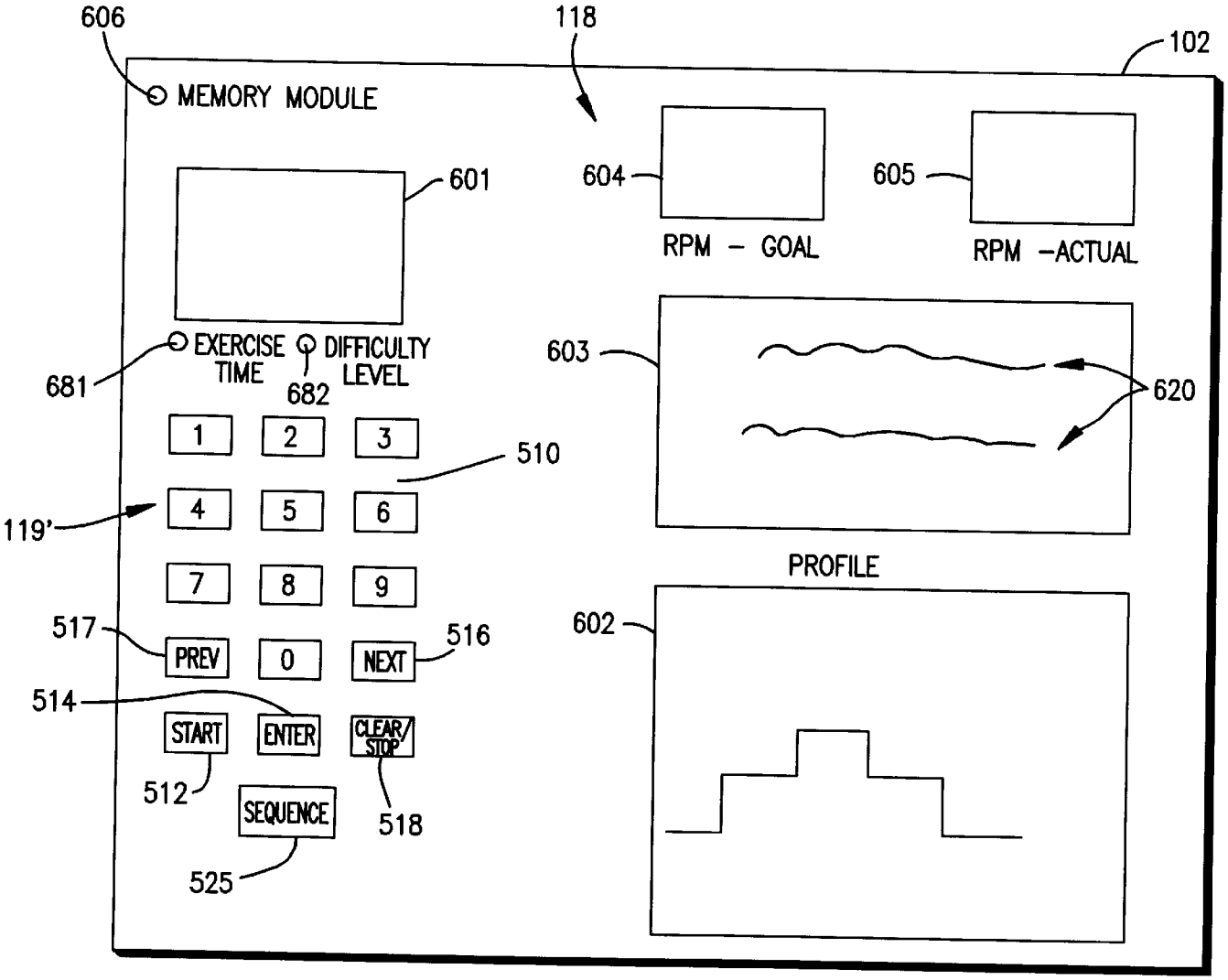
FIG. 8B illustrates a keypad for display and keypad panel 102 which is usable to execute an exercise program sequence.

In accordance with a second embodiment of the instant invention, portable memory module 103 may store an exercise program sequence which includes a plurality of exercise programs designed to be used sequentially by an exerciser. FIG. 8A illustrates table depicting an organization of an exercise program sequence and FIG. 8B illustrates a modified keypad 119' for permitting an exerciser to select a next program in the exercise program sequence. Exercise program 1 is stored at memory location 1, defined, for example, by a memory address. If desired, a program name and description, a difficulty level, and/or an exercise time may be associated with exercise program 1. A pointer to the next program in the sequence and a flag are associated with exercise program 1. Exercise programs 2, 3, . . . , n are stored at memory locations 2, 3, . . . , n as shown. Of course, additional exercise programs organized in the manner discussed above with respect to FIG. 6 may also be included on portable memory module 103 in accordance with this second embodiment. The operating program of microcomputer 113 stored in ROM 115 is configured to respond to an actuation of a SEQUENCE key 525 (FIG. 8B) to cause microcomputer 113 to search for the one of programs 1, 2, . . . , n having a set flag. The exerciser is then prompted to select this program and to set an exercise time and/or difficulty level, if appropriate. The sequence of exercise programs may, for example, be a series of alternating difficult/easy exercise programs designed to reduce the possibility of overexertion and/or injury. Alternatively, this program sequence may be developed by a personal trainer or physician. Such a series of exercise programs may be provided, for example, so that an exerciser may vary the intensity of a workout over a predetermined time period such as a week to achieve an exerciser's goal, e.g., fat loss or cardiorespiratory fitness. When a portable memory module is plugged into port 114 and detected by microcomputer 113, an exerciser actuates SEQUENCE key 525 to cause microcomputer 113 to search for the next exercise program in the exercise program sequence. As noted, the next program in the sequence is defined by a set flag and microcomputer 113 causes a display of the corresponding program name and description on line display portion 603 and additionally or alternatively displays the corresponding graphical profile of the exercise level versus time on display portion 602. If the exerciser selects this exercise program, microcomputer 113 clears (resets) the set flag and uses the pointer to set appropriately the flag for the next exercise program in the sequence. If the exerciser for some reason wishes to skip the current program in the sequence or to select an exercise program not in the sequence (such as one of the additional exercise programs on portable memory module 103 or one of the pre-stored exercise programs in ROM 115), NEXT key 516 and PREV key 517 may be used as described above in the first embodiment. Of course, the use of flags and pointers to define the sequence is illustrative, and other techniques for defining an exercise program sequence may be utilized within the scope of this invention. For example, a memory portion may be used to store indicia regarding the next program in the sequence. In this case, when SEQUENCE key 525 is actuated, microcomputer 113 accesses this memory portion to determine which program is next in the sequence and subsequently writes indicia to the memory portion indicating the next program in the sequence. Also, while this embodiment has been described with respect to an exercise program sequence stored on a portable memory module, an exercise program sequence may additionally or alternatively be stored in ROM 115.

Figure 9A:
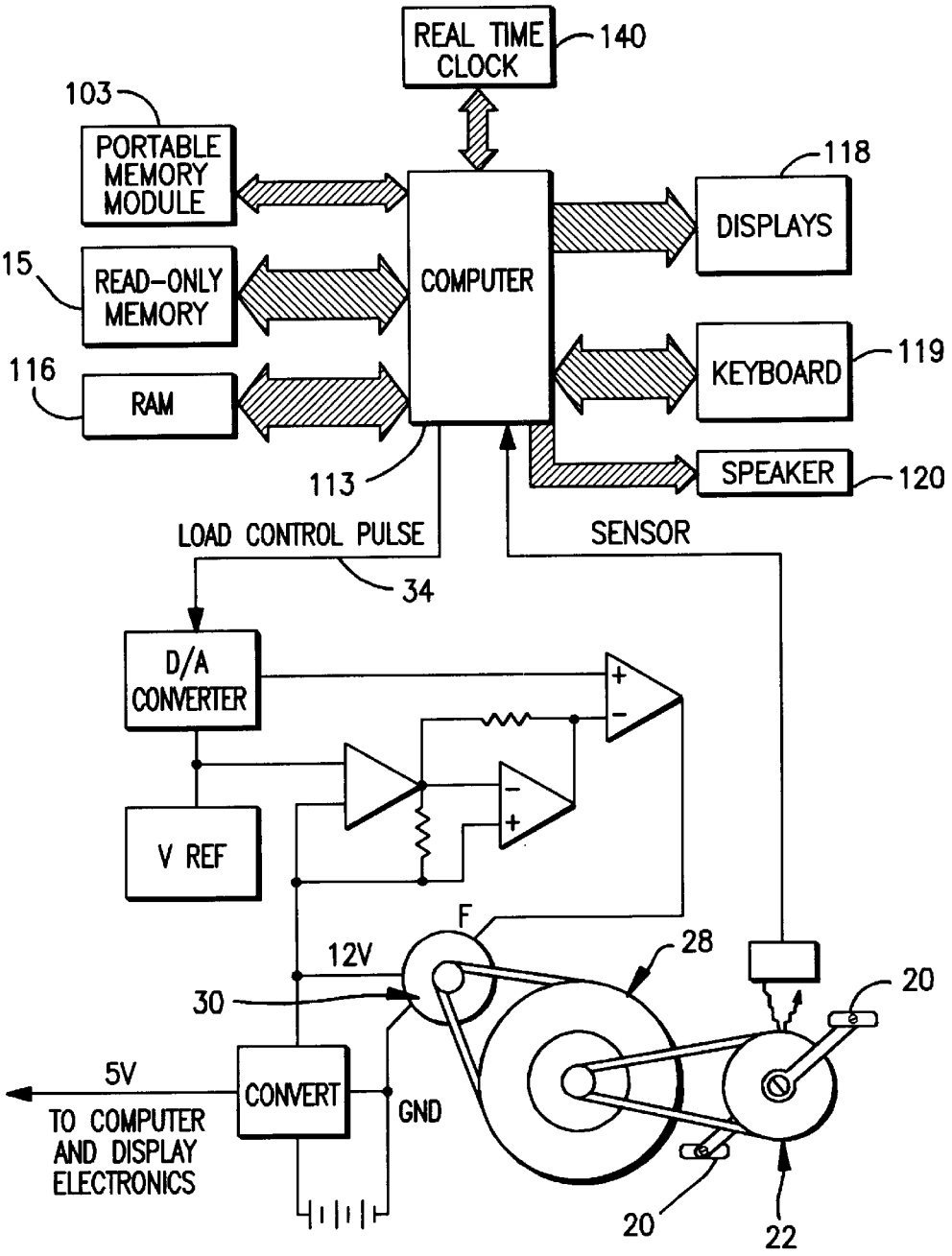
FIG. 9A illustrates an electronic control system which includes a real time clock.
Figure 9B:
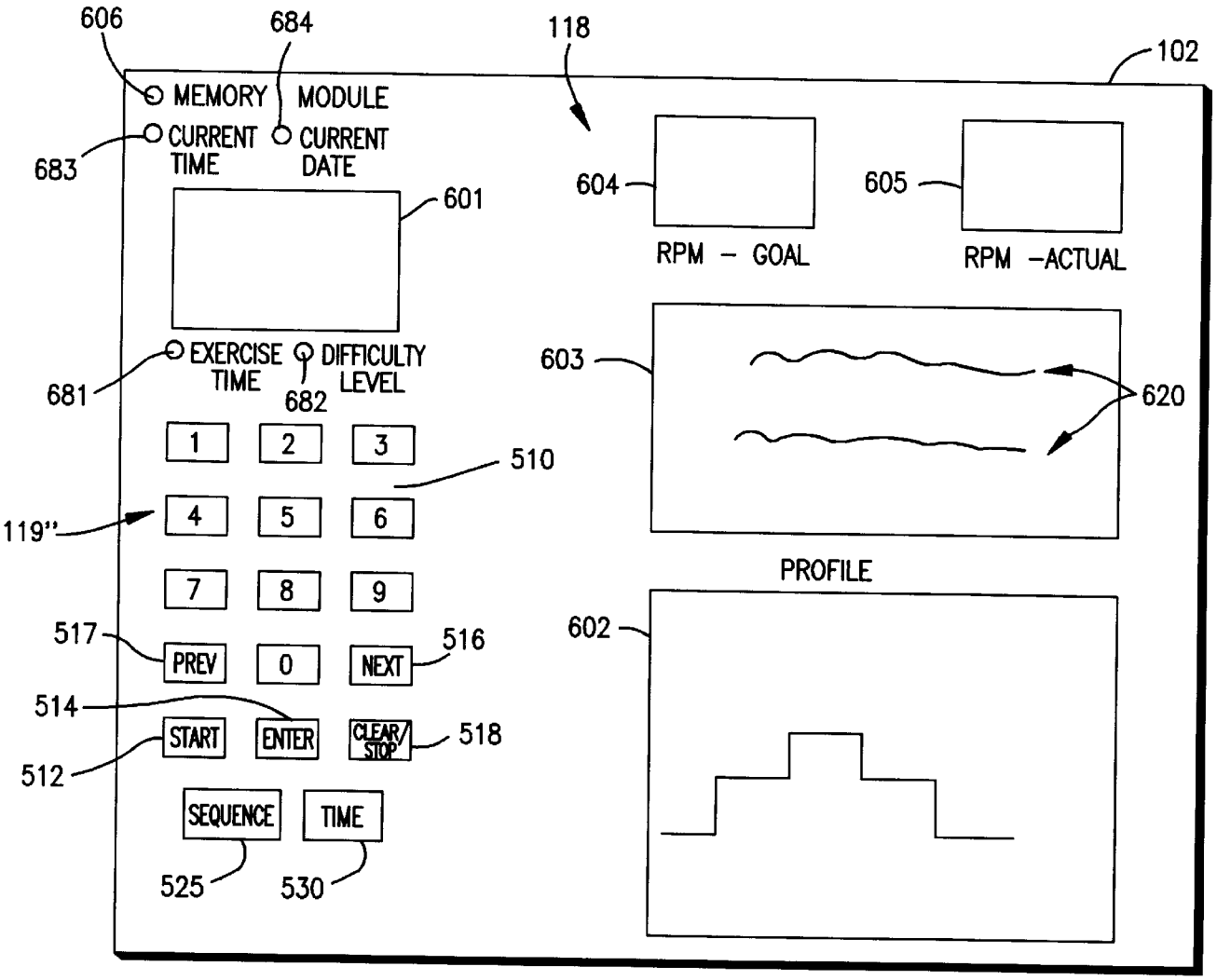
FIG. 9B illustrates a display and keypad for display and keypad panel 102 which permits an exerciser to enter a real time.

A first modification of the second embodiment will be discussed with reference to FIGS. 9A, 9B, and 9C. FIG. 9A illustrates a control system which includes a real time clock 140; FIG. 9B illustrates a keypad and display portion for permitting an exerciser to enter a real time; and FIG. 9C is a table depicting an organization of an exercise program sequence. Real time clock 140 provides a real time signal. With reference to FIG. 9B, keypad 119" includes a TIME key 530 which may be actuated by an exerciser. The operating program of microcomputer 113 responds to this actuation of TIME key 530 by displaying the currently set time and date on display portion 601. Current time indicator 683 and current date indicator 684 are illuminated appropriately. The operating program of microcomputer 113 responds to an actuation of TIME key 530 followed within a predetermined period of time by an actuation of ENTER key 514 by prompting an exerciser via display portion 601, line display portion 603, current time indicator 683, and current date indicator 684 to enter a current time and date using numeric keypad 510. For example, after pressing the TIME key 530 and the ENTER key 514, line display portion 603 may prompt a user to enter the current hour and then press ENTER key 514; to enter the current minute and then press ENTER key 514; and to enter "1" for AM or "2" for PM and then press ENTER key 514. Current time indicator 683 may be illuminated while this current time information is input. The user may then be prompted by line display portion 603 to enter the current month (e.g., "1" for January, "2" for February, etc.) and then press ENTER key 514; to enter the current date and then press ENTER key 514; and to enter the last two digits of the current year and then press ENTER key 514. Current date indicator 684 may be illuminated while this current date information is input. Of course, this method of entering current time and current date is for illustrative purposes only, and the invention is not limited in this respect. With respect to FIG. 9C, exercise program 1 is stored at memory location 1, defined, for example, by a memory address. A day of the week is associated with exercise program 1. If desired, a program name and description, a difficulty level, and/or an exercise time may also be associated with exercise program 1. Programs 2, . . . , 7 are stored at memory locations 2 . . . , 7, respectively and are each associated with a different day of the week. Of course, additional programs such as those illustrated in FIG. 6 may also be included on portable memory module 103. An exercise program sequence associated with days of the week permits a trainer or a physician to provide an exerciser with a training routine for Sunday through Saturday. When portable memory module 103 is plugged into port 114 and the exerciser actuates SEQUENCE key 525, microcomputer 113 determines the current day of the week using real time clock 140 and then displays the name and description on line display portion 602 and additionally or alternatively the graphical profile of exercise level versus time on display portion 602 associated with the exercise program corresponding to the current day of the week. The exerciser may select this program by actuating the ENTER key or may utilize the PREV and NEXT keys to step through the programs stored on portable memory module 103 or in ROM 115 in the manner discussed above. A system in accordance with this modification permits a personal trainer, for example, to provide a series of exercise programs tailored to a particular individual and simplifies the steps required to be followed by the exerciser in order to follow a personal trainer's training routine. In a variation of this modification, the exercise programs may be associated with particular dates such as May 1, 1995; May 2, 1995; etc. When portable memory module is plugged into port 114 and the exerciser actuates SEQUENCE key 525, microcomputer 113 determines the current date and displays the program identifier and/or exercise profile of the exercise program corresponding to the current date. As before, the exerciser may utilize ENTER key 514 to select the exercise program corresponding to the current date, or use the PREV and NEXT keys to select from one of the programs stored on portable memory module 103 or in ROM 115 in the manner discussed above.

As noted above, although the above description is based on a stationary bicycle, the present invention is generally applicable to any exercise apparatus whose exercise level is controllable in accordance with a program. Such apparatus are manufactured, for example, by Life Fitness, NordicTrack, Nautilus, and the like. Thus, for example, for a treadmill, control signals may control the speed of the tread and/or the inclination of the tread to the horizontal. For a stair climber, the control signals may control the resistance of the pedals. For a weight machine, the control signals may control the resistance.

As illustrated in FIG. 10, a portable memory module may store exercise programs for different exercise apparatus, e.g., a stationary bicycle and a treadmill. This may be accomplished by associating an apparatus identifier with each apparatus and with each exercise program. An exercise apparatus would be able to execute exercise programs having a corresponding apparatus identifier.

As illustrated in FIG. 11, the portable memory module may also include a memory portion for storing a training or workout history containing information such as the type of exercise apparatus used, the date of the workout, whether the person completed the exercise which was started, the exercise program name, exercise difficulty level, exercise time, etc. The completion of an exercise program may be determined, for example, by whether an exerciser presses CLEAR/STOP key 518 during execution of the program or simply stops the exercise, e.g., stops pedaling. This history can assist a trainer or a physician, for example, in determining the progress of an exerciser and in selecting new exercise programs for improving the fitness level of the exerciser.

Each of the above-referenced patent documents is hereby incorporated by reference into the instant specification.

While there has been shown and described the preferred embodiments of the invention, it will be evident to those skilled in the art that various modifications may be made thereto without departing from the spirit and scope of the invention which is set forth in the appended claims.

I claim:

1. A portable memory module, comprising a memory for storing information which is usable for controlling the operation of an exercise device, said memory further storing identifiers each of which identifies corresponding information as usable for controlling the operation of a particular type of exercise device, wherein the identifiers include a first identifier for identifying first information stored in said memory as usable for controlling the operation of a first type of exercise device and a second identifier for identifying second information as usable for controlling the operation of a second type of exercise device different than the first type of exercise device.

2. The portable memory module according to claim 1, wherein said information usable for controlling the operation of an exercise device comprises exercise programs.

3. Exercise apparatus, comprising:

an exercise device;

a control unit;

a first memory which is part of a portable memory module and a second memory which is not part of a portable memory module, said first and second memories each storing respective information which is usable by said control unit for controlling the operation of said exercise device; and an interface for permitting an exerciser to select information stored in either one of said first and second memories.

4. The exercise apparatus according to claim 3, wherein said information stored in said first and second memories comprises exercise programs.

5. Exercise apparatus, comprising:

an exercise device;

a control unit; and a memory for storing information which is usable by said control unit for controlling the operation of said exercise device and for storing sequence data for defining a sequence of said information, wherein said control unit is configured to use said sequence data to select said information from said memory in the sequence defined by the sequence data.

6. The exercise apparatus according to claim 5, wherein said memory is a portable memory module.

7. The exercise apparatus according to claim 6, wherein said control unit is further configured to write indicia regarding the selected information to said portable memory module.

8. The exercise apparatus according to claim 5, wherein said exercise device is a stair climber.

9. The exercise apparatus according to claim 5, wherein said exercise device is a stationary bicycle.

10. The exercise apparatus according to claim 5, wherein said exercise device is a treadmill.

11. The exercise apparatus according to claim 5, wherein said exercise device is a weight machine.

12. The exercise apparatus according to claim 5, wherein said at least two exercise programs include exercise programs arranged in an exercise program sequence and said selecting means comprises means for sequentially selecting the exercise programs in said exercise program sequence.

13. The exercise apparatus according to claim 12, wherein the exercise programs of said exercise program sequence are respectively associated with a day of the week.

14. The exercise apparatus according to claim 5, wherein the sequence data comprises date data.

15. The exercise apparatus according to claim 5, wherein said portable memory module includes an EEPROM.

16. The exercise apparatus according to claim 5, wherein said information stored in said memory comprises exercise programs and the sequence data defines a sequence of said exercise programs, wherein said control circuit is configured to use said sequence data to select said exercise programs in the sequence defined by the sequence data.

17. Exercise apparatus, comprising:

an exercise device;

a control unit;

a real time clock for generating real time signals; and a memory for storing information which is usable by said control unit to control the operation of said exercise device and for storing real time data associated with said information, wherein said control unit is configured to use the generated real time signals and the stored real time data to select said information.

18. The exercise apparatus according to claim 17, wherein said memory is a portable memory module.

19. An exercise apparatus, comprising:

an exercise device usable by an exerciser;

a control unit; and a memory for storing information which is usable by said control unit for controlling the operation of said exercise device during use by the exerciser and for storing sequence data for defining a sequence of said information, wherein said control unit is configured to use said sequence data to select from said memory first information in said sequence when the exerciser uses said exercise device a first time, and said control unit is configured to use said sequence data to select from said memory second information in the sequence when the exerciser uses said exercise device a second time subsequent to the first time.

20. The exercise apparatus according to claim 19, wherein said memory comprises a portable memory module.

21. The exercise apparatus according to claim 19, further comprising:

an input device, wherein said control unit is responsive to an input of the exerciser via said input device to use the information selected by said control unit from said memory for controlling the operation of said exercise device.

* * * * *

UNITED STATES PATENT AND TRADEMARK OFFICE

CERTIFICATE OF CORRECTION

PATENT NO. : 5,947,869
DATED : September 7, 1999
INVENTOR(S) : Michael J. Shea

It is certified that error appears in the above-identified patent and that said Letters Patent is hereby corrected as shown below:

Title page,
Item [56], References Cited, insert the following U.S. PATENT DOCUMENTS,

| | | | |
|---|---|---|---|
| -- | 5,512,025 | 4/1996 | Dalebout et al. |
| | 5,462,504 | 10/1995 | Trulaske et al. |
| | 5,410,472 | 4/1995 | Anderson |
| | 5,067,710 | 11/1991 | Watterson et al. |
| | 5,020,795 | 6/1991 | Airy et al. |
| | 4,934,694 | 6/1990 | McIntosh |
| | 4,842,274 | 6/1989 | Oosthuizen et al. |
| | 4,828,257 | 5/1989 | Dyer et al. |
| | 4,708,337 | 11/1987 | Shyu |
| | 4,571,682 | 2/1986 | Silverman et al. |
| | 4,112,928 | 9/1978 | Putsch -- |

Column 10,
Lines 58-62, delete claim 12.
Beginning at line 63, amend claim 13 as follows:
13. The exercise apparatus according to claim 5, wherein the sequence data comprises day of the week data.

Signed and Sealed this

Sixteenth Day of July, 2002

*Attest:*

*Attesting Officer*

JAMES E. ROGAN
*Director of the United States Patent and Trademark Office*